US005189765A

United States Patent [19]

Singhal

[11] Patent Number: 5,189,765

[45] Date of Patent: Mar. 2, 1993

[54] ZIPPER JOINT BETWEEN TWO SURFACES

[76] Inventor: Tara C. Singhal, P.O. Box 5075, Torrance, Calif. 90510

[21] Appl. No.: 730,478

[22] Filed: Jul. 16, 1991

[51] Int. Cl.[5] ..... A44B 19/16

[52] U.S. Cl. ..... 24/400

[58] Field of Search ..... 24/400, 399, 389, 384, 24/587; 383/64, 69

[56] References Cited

U.S. PATENT DOCUMENTS

| | | | |
|---|---|---|---|
| 2,794,227 | 6/1957 | Dorman | 24/399 |
| 3,074,137 | 1/1963 | Hawley | 24/400 |
| 3,426,396 | 2/1969 | Laguerre | 24/399 X |
| 3,660,875 | 5/1972 | Gutman | 24/400 |
| 5,020,194 | 6/1991 | Herrington et al. | 24/400 |

FOREIGN PATENT DOCUMENTS

| | | | |
|---|---|---|---|
| 1043998 | 11/1953 | France | 24/400 |

*Primary Examiner*—James R. Brittain

[57] ABSTRACT

This device creates a joint between two flexible surfaces that can be done and undone with the ease of an ordinary zipper. The device consists of edges on the surfaces to be joined. These edges consist of continuous multiple channels in the form of ridges and grooves and a joining aid in the form of a Flared Y shape tube which when pulled over the surface edges to be joined would apply force in four directions and would force the grooves and ridge channels to fit in each other at the correct angles creating a multiple seal, thereby each of the seals consisting of tightly fitting rod and its corresponding groove. The groove channel openings are offset from each other creating a joint resistance to pull in any direction. The flared Y tube has three tapered edges inside the tube which apply force in separating the three rod/groove sets if the tube is pulled over the joint in the reverse direction.

6 Claims, 2 Drawing Sheets

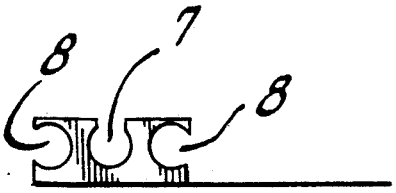
FIG. 1b.
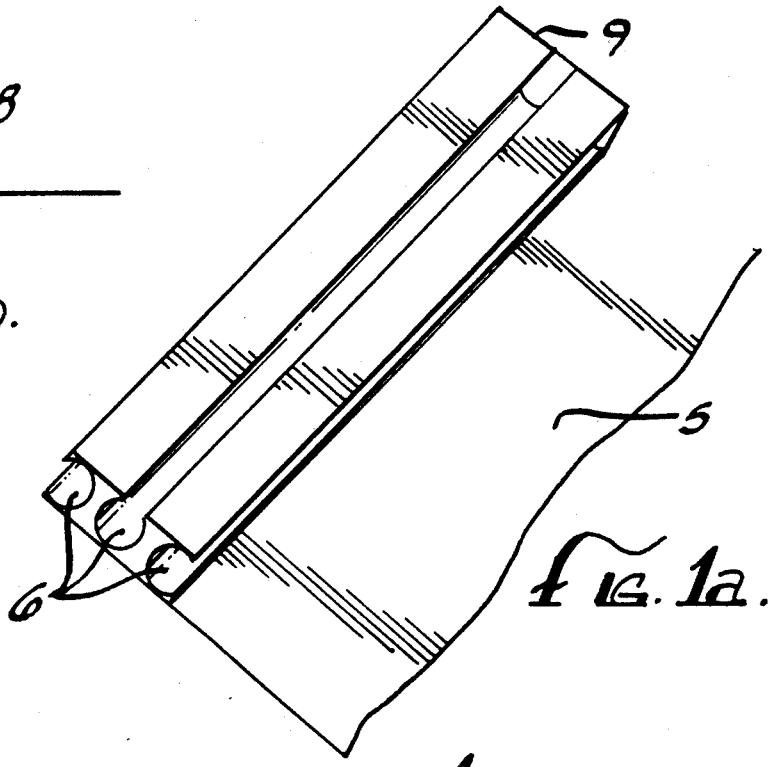
FIG. 1a.
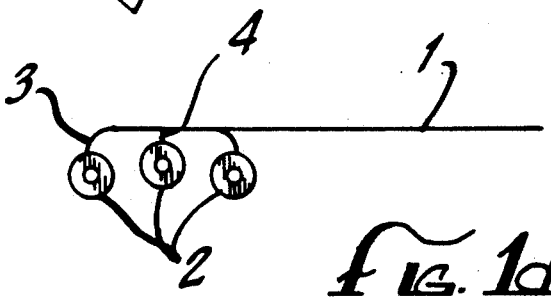
FIG. 1d.
FIG. 1c
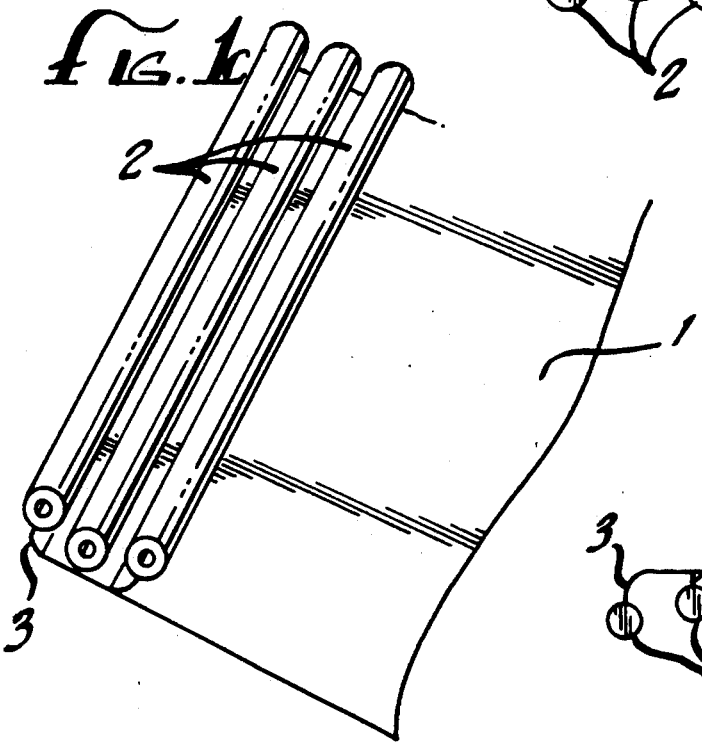
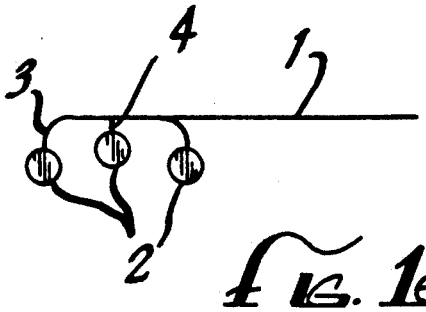
FIG. 1e.

ZIPPER JOINT BETWEEN TWO SURFACES

BACKGROUND OF THE INVENTION (1) Field of Invention

The ordinary zipper is a versatile means to join two surfaces. This invention is different than an ordinary zipper in that it creates a seamless and continuous joint which is also water proof. In many applications it is desirable to create a water proof joint with same ease with which a zipper is used to zip and unzip the surfaces. The invention described herein is a device and means to create waterproof joint with the ease of a zipper. In addition this joint is strengthened against pull at any angle. This invention would be useful in applications such as joining pipe coverings, joining blankets, joining coverings made of flexible rubber or plastic (boots) for machinery parts such as links and joints, joining weather protective coverings on building, goods or other articles, joining clothing surfaces where waterproofing is required, and as well as many other applications too numerous to enumerate.

(2) Description of Related Art

None to my knowledge.

SUMMARY OF THE INVENTION

This device enables joining together two surface edges made of any suitable material such as cloth, plastic, nylon, synthetic, composite material etc. and create a water proof strong joint resistant to pulling force in any direction.

BRIEF DESCRIPTION OF THE DRAWING

FIG. 1(*a*) is a perspective front view of a female edge useful in the invention;

FIG. 1(*b*) is a side view of the female edge shown in FIG. 1(*a*);

FIG. 1(*c*) is a perspective front view of a male edge useful in the invention;

FIG. 1(*d*) is a side view of a hollow male edge useful in the invention;

FIG. 1(*e*) is a side view of a solid male edge useful in the invention;

FIG. 2(*b*) is a side view of a fastener having features of the invention, with the fastener unattached;

FIG. 2(*c*) is a top view of the joining device shown in FIG. 2(*a*); and FIG. 2(*d*) is a side view of a fastener having features of the invention, with the fastener attached.

FIG. 2(*e*) is a side view of a fastener having features of the invention, with the fastener partially attached.

DESCRIPTION OF THE PREFERRED EMBODIMENT

Refer to FIG. 1. One of the surface to be joined(1) has an edge or attached to an edge (male edge) which consists of continuous ridges in the form of tiny rods(2). These rod ridges could be either hollow or solid depending upon the size of the joint and the material used in the joint. There are three rod ridges in the form of rods parallel to each other(2). These rod ridges are attached to the edge with continuous extension edges through the length of the rod ridge(3). The central rod ridge is attached by a smaller extension ridge compared to the other two rod ridges, thereby offsetting in or indenting in, in relation to the other outer two rod ridges(4). The other surface edge (female edge)(5) to be joined with the first surface has channels in the form of tiny continuous grooves. There are three groove channel parallel to each other(6). The center groove channel's opening is at right angles to the plane of the surface to be joined(7), the other two groove channel's opening, the inner and outer are placed at an angle to the surface being joined(8). The opening angle of one channel is approximately zero degrees, which makes it approx. 90 degrees away from the central channel. The opening angle of the other channel is approximately 180 degrees, which makes it approx. 90 degrees away in the opposite direction from the central channel(8). The spacing between these channels is same as the spacing between the channels on the other male edge surface to be joined. The lengthwise end of the female edge end in a ridge wall(9). The edge and the channel is made of suitable material suitable for this purpose such as plastic, nylon or other suitable synthetic or composite material.

Figure 2A:
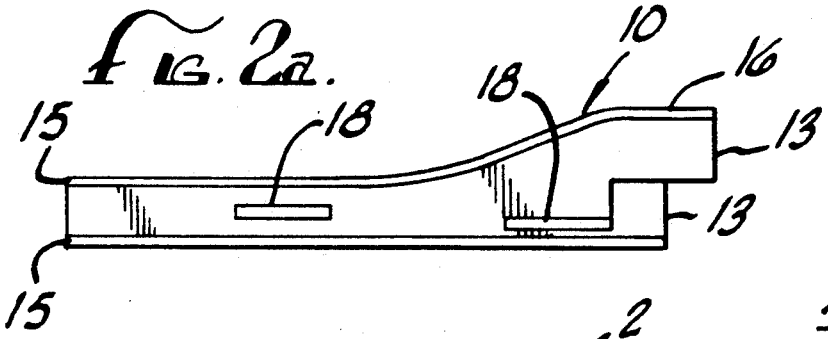
FIG. 2(*a*) is a side view of a joining device useful in the invention.
Figure 2B:
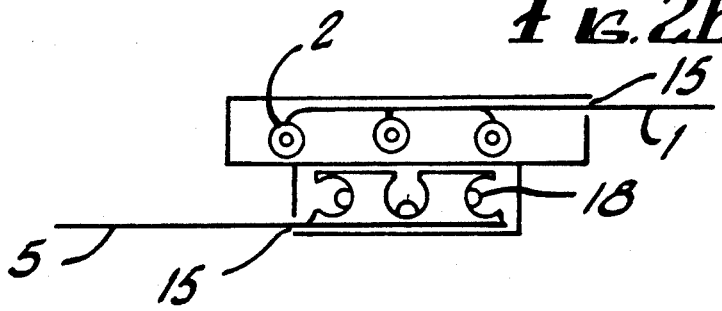
Figure 2C:
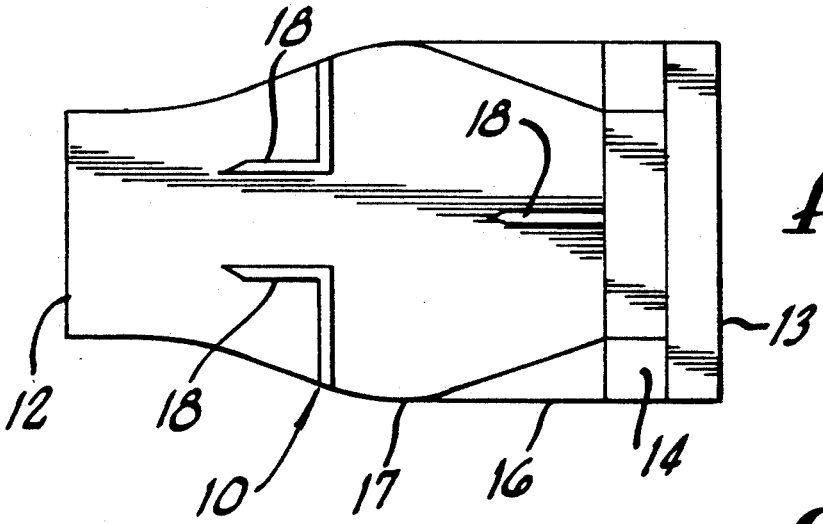
Figure 2D:
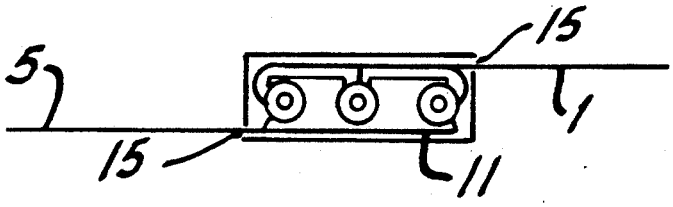
Figure 2E:
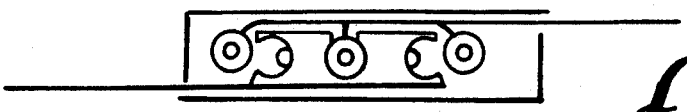

Refer to FIG. 2. A joining aid in the form of a Flared Y shape tube(10) which when pulled over the surface edges to be joined would apply force in two side direction for the two edge channel/rod sets and force in the up/down direction for the middle rod/groove channels and would force the grooves and rod channels to fit or snap into each other at the correct angles thereby creating a triple seal. Each of the three seals would consist of tightly fitting rod and its corresponding groove.(11)

The flared Y shape tube has two openings, the lower opening is rectangular with the length and width that would enable the triple seal joint, consisting of three rod/groove sets(12), to pass through. The upper opening consists of two rectangular opening, one for the female edges to pass through and the other of slightly wider dimension for the male edge to pass through(13). These two openings being separated by a metal plate which separates the male and female edges as they come out of the upper opening of the joining aid(14). The lower rectangular opening has two cuts on two opposite surface, offset from the center of the surface on opposite sides which continue through the length of the tube(15). This allows the two edge surfaces to be joined, to slide through. The rest of the tube is made up of a flared half Y side portion(16) and a half bubble side portion(17), positioned in relation to each other such that it would allow the two edges to mate with each other in such a way that the central rod/groove of the female and male edges is joined first and then the two side rod/groove channels are joined after that.

Inside the joining aid, there are three tapered ended edges placed inside the middle of the tube in such a way that the tapered edges would be positioned under the rods and would apply separation force to force the each of the rods from its groove such that the two joined edges would separate, if it was decided to pull the Y tube in reverse direction to separate the joint(18). The two outer tapered edges of the three edges are placed lower than the middle tapered edge, so that the two end rod/groove sets would separate first and then the central rod/groove set would separate, for this type of particular joint. The two halves of the tube are joined near the inside of the larger opening with a horizontal plate which separates the two edges being joined(14).

The lengthwise ends of the female edge end in a ridge wall(9), which along with the three tapered edges stop the joining aid from falling off the female edge.

Therefore I claim:

1. A fastener comprising:

(a) two edges to be joined together made of plastic/-nylon type material, (b) one edge being a male edge consisting of three continuous ridges in the form of cylindrical rods defining a central rod and two outer rods one on each side of the central rod, (c) the other edge being a female edge consisting of continuous hollow cylindrical channels wherein the number of channels equals the number of rods and the channels define a central channel and two outer channels one on each side of the central channel, (d) the channels have longitudinal openings that are at different angles from each other's channel openings, (e) the central rod and channel of the said three rods and the channels in said male and female edges can fit into and snap into each other when compression force is applied from above and below said edges and when overlaid on top of each other, (f) the two outer of the said rods and channels can fit into each other and snap into each other when compression force is applied sideways and when the outer rods and channels are laid side by side, (g) a joining aid in the form of a tube which when pulled over said male and female edges in one direction applies force to join the edges, and (h) the joining aid which when pulled over said male and female edges in the reverse direction assist in separating the edges.

2. A fastener according to claim 1 wherein (a) each of the three cylindrical rods is of thickness and size that fits in a corresponding channel, (b) the three cylindrical rods are each attached to or hanging from the connecting edge by a web like extension ridge, and (c) the two outer cylindrical rods are hung from slightly longer web like extension ridges than that of the central cylindrical rod.

3. A fastener according to claim 2 wherein each said cylindrical rod is solid.

4. A fastener according to claim 2 wherein each cylindrical rod is hollow.

5. A fastener according to claim 1 wherein (a) said female edge has three continuous channels running each with a cross section nearly circular along the connecting edge, (b) each of the three channels is of such thickness and size that would receive and fit inside it a corresponding rod, (c) the three channels are attached to the connecting edge at different angles such that the central channel opening is perpendicular to each of the outer channel openings, and the outer channel openings are approximately 180 degrees apart, and (d) the lengthwise ends of the female edge end in a bridge wall.

6. A fastener according to claim 1 wherein the joining aid comprises, (a) a rectangular shaped lower opening with the same length and width as the three rod/channel sets, (b) an upper opening consisting of two rectangular openings one of slightly wider dimension than the other, these upper rectangular openings being separated by a metal plate, (c) the rest of the said aid being made up of bulges in the center along the horizontal plane and a flared half Y side on a top part of a vertical plane and a flat side on a bottom part of the vertical plane, (d) the bulge and the flared half Y are approximately positioned in relation to each other such that where the bulge ends the flared half Y begins, (e) the aid has two cuts that are offset from a center of the surface on opposite sides which continue through the length of the aid, (f) in the interior of the aid near the upper opening there are three smooth tapered ended short rod like protruding edges defining a central protruding edge and two outer protruding edges, one on each side of the central protruding edge, and (g) the central rod like protruding edge is offset from the other outer two rod like protruding edges.

* * * * *